United States Patent [19]

Clatterbuck et al.

[11] Patent Number: 4,510,476

[45] Date of Patent: Apr. 9, 1985

[54] HIGH VOLTAGE ISOLATION TRANSFORMER

[75] Inventors: Carroll H. Clatterbuck, Silver Spring; Arthur P. Ruitberg, Germantown, both of Md.

[73] Assignee: The United States of America as represented by the Administrator of the National Aeronautics and Space Administration, Washington, D.C.

[21] Appl. No.: 506,477

[22] Filed: Jun. 21, 1983

[51] Int. Cl.[3] ..... H01F 15/04

[52] U.S. Cl. ..... 336/84 C; 336/198

[58] Field of Search ..... 336/84 C, 84 R, 69, 336/70, 198, 208, 196

[56] References Cited

U.S. PATENT DOCUMENTS

| | | | |
|---|---|---|---|
| 1,523,891 | 1/1925 | Petersen et al. | 336/196 |
| 2,170,048 | 8/1939 | Dunning et al. | 336/196 |
| 2,385,460 | 9/1945 | Omansky | 336/196 |
| 2,390,800 | 12/1945 | Madsen | 336/196 |
| 2,413,195 | 12/1946 | Schwager | 336/196 |
| 2,612,545 | 9/1952 | Gray | 336/196 |
| 2,827,616 | 3/1958 | Manning | 336/196 |
| 3,070,766 | 12/1962 | Purdy | 336/196 |
| 3,265,998 | 8/1966 | Park | 336/84 C X |
| 4,176,334 | 11/1979 | Buritz et al. | 336/84 C |
| 4,333,900 | 6/1982 | Carey | 336/84 C X |
| 4,379,999 | 4/1983 | Kimura | 336/84 C |

FOREIGN PATENT DOCUMENTS

| | | | |
|---|---|---|---|
| 948585 | 2/1964 | United Kingdom | 336/84 C |

*Primary Examiner*—Thomas J. Kozma

*Attorney, Agent, or Firm*—John O. Tresansky; John R. Manning

[57] ABSTRACT

A high voltage isolation transformer (10) is provided with primary (30) and secondary (32) coils separated by discrete electrostatic shields from the surfaces of insulating spools (12,14) on which the coils are wound. The electrostatic shields are formed by coatings (49,59,50,60) of a compound having a low electrical conductivity which completely encase the coils and adhere to the surfaces of the insulating spools (12,14) adjacent to the coils. Coatings (47,48) of the compound also line axial bores of the spools, thereby forming electrostatic shields separating the spools from legs (18,20) of a ferromagnetic core (16) extending through the bores. The transformer is able to isolate a high constant potential applied to one of its coils, without the occurrence of sparking or corona, by coupling the coatings lining the axial bores to the ferromagnetic core and by coupling one terminal of each coil to the respective coating encasing the coil.

16 Claims, 5 Drawing Figures

HIGH VOLTAGE ISOLATION TRANSFORMER

ORIGIN OF THE INVENTION

The invention described herein was made by employees of the United States Government and may be manufactured and used by or for governmental purposes without the payment of any royalties thereon or therefor.

TECHNICAL FIELD

This invention relates to electrical transformers and, more particularly, to a high voltage isolation transformer.

One of the primary functions of an isolation transformer is to provide sufficient inductive coupling between primary and secondary windings for an efficient transfer of power from alternating currents applied to the primary winding while tolerating the stress of a constant potential difference between the windings when a large voltage is present on one of the windings. Typically, this has been achieved by selective arrangements of air gaps between the primary and secondary windings and by placing layers of electrical insulation and electrostatic shields of various configurations between the windings. These techniques have proven to be inadequate, however, when the constant potential on one of the windings creates electric field stresses on an order of one hundred volts per mil between the transformer's coils and its core. Field stresses of this magnitude cause arcing across air gaps and corona discharge around the shielding. Moreover, such field stresses cause sparking across air pockets formed between adjacent winding turns, between the windings and insulation, and between the insulation and the core. Continued operation of a transformer at such magnitudes of field stress causes ionization of air within such pockets and a concomitant heating of adjoining transformer surfaces. The heating leads to pitting of the transformer's conductive surfaces and the formation of microcracks in its insulation. Local discontinuities in the insulation caused by the microcracks provide paths of gradually decreasing resistance through the insulation which, over time, enlarge in length and width and ultimately provide a short circuit resulting in catastropic failure of the transformer.

Attempts to avoid corona discharge and sparking have included the use of flat, ribbon-like conductors wound in concentric turns separated by layers of a resilient insulating material. Although such a technique largely eliminates sparking by avoiding the occurrence of air pockets, it does so at the expense of limiting the number of turns which the windings may have. Other attempts have included placing the entire transformer in a vacuum inside a sealed container. In most instances this has proved to be impractical because the manufacture of a vacuum tight container capable of accommodating passage of leads is more complicated than the construction of the transformer itself and unreliable because any leak in the vacuum will result in sudden failure of the transformer.

STATEMENT OF INVENTION

Accordingly, it is one object of the present invention to provide an improved isolation transformer.

It is another object to provide a transformer able to isolate a very high voltage applied to one winding while a constant potential is applied between the windings.

It is still another object to provide an isolation transformer which can be reliably operated at high voltages without degradation due to the occurrence of electric field stress.

It is a further object to provide an isolation transformer which can be reliably operated at voltages on the order of eighty kilovolts.

It is also an object to provide a compact, high voltage isolation transformer.

Briefly, these and other objects are achieved with a isolation transformer having primary and secondary coils wound around separate spool insulators and encased in electrically conductive coatings adhering to the surfaces of the spools. The spools have axial bores lined with electrically conductive coatings adhering to the surfaces of the bores and are mounted upon opposite legs of a magnetic core passing through their axial bores.

BRIEF DESCRIPTION OF DRAWINGS

A more complete appreciation of this invention and many of the attendant advantages thereof, will be readily apparent as the same becomes better understood by reference to the following detailed description when considered in conjunction with the accompanying drawings in which like numbers indicate the same or similar components, and wherein.

DETAILED DESCRIPTION OF THE INVENTION

Figure 1:
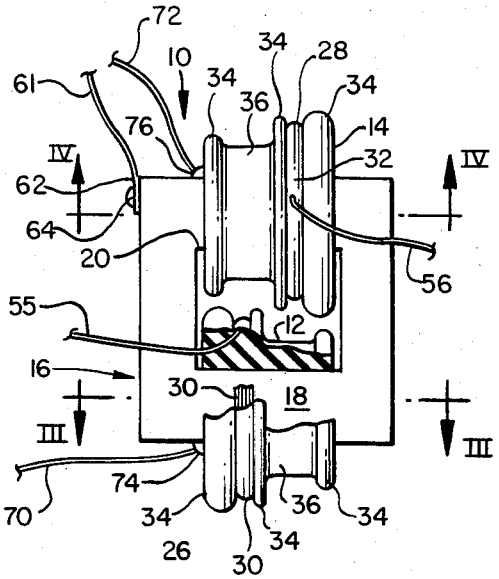
FIG. 1 is a partially cut-away front view of an embodiment of the invention.
Figure 2:
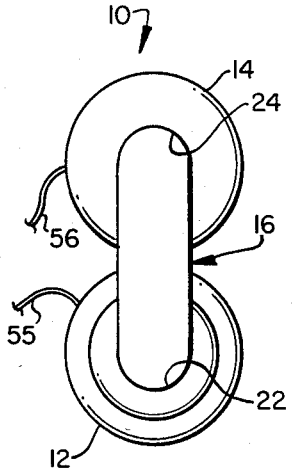
FIG. 2 is a side view of the embodiment shown in FIG. 1.

The high voltage isolation transformer 10 according to this invention is shown in FIGS. 1 and 2 as having primary and secondary solid spools 12, 14, respectively, made of an insulating material exhibiting a high dielectric strength, such as polycarbonate, a thermoplastic polymer. Both spools are mounted on a four-sided ferro-magnetic core 16 formed of a pair of low loss segments of a material such as a manganese zinc ceramic ferrite which provides a closed magnetic flux path. Opposite parallel legs 18, 20 of core 16 pass through the axial bores 22, 24 of the primary and secondary spools 12, 14, respectively. Both spools contain a circumferential channel 26, 28 to receive annularly wound primary and secondary coils 30, 32, respectively.

The spools are made in an alternating arrangement of circumferential rings 34 and recesses 36 to provide longer arc paths between the coils and the transformer core. The rings and recesses on each spool are axially spaced to accommodate adjacent recesses and rings of the other spool and thereby permit the spools to be closely positioned around parallel legs 18, 20 in a mutual head-to-toe arrangement, thus providing a compact transformer configuration with maximum separation between primary and secondary coils 30, 32.

Figure 3:
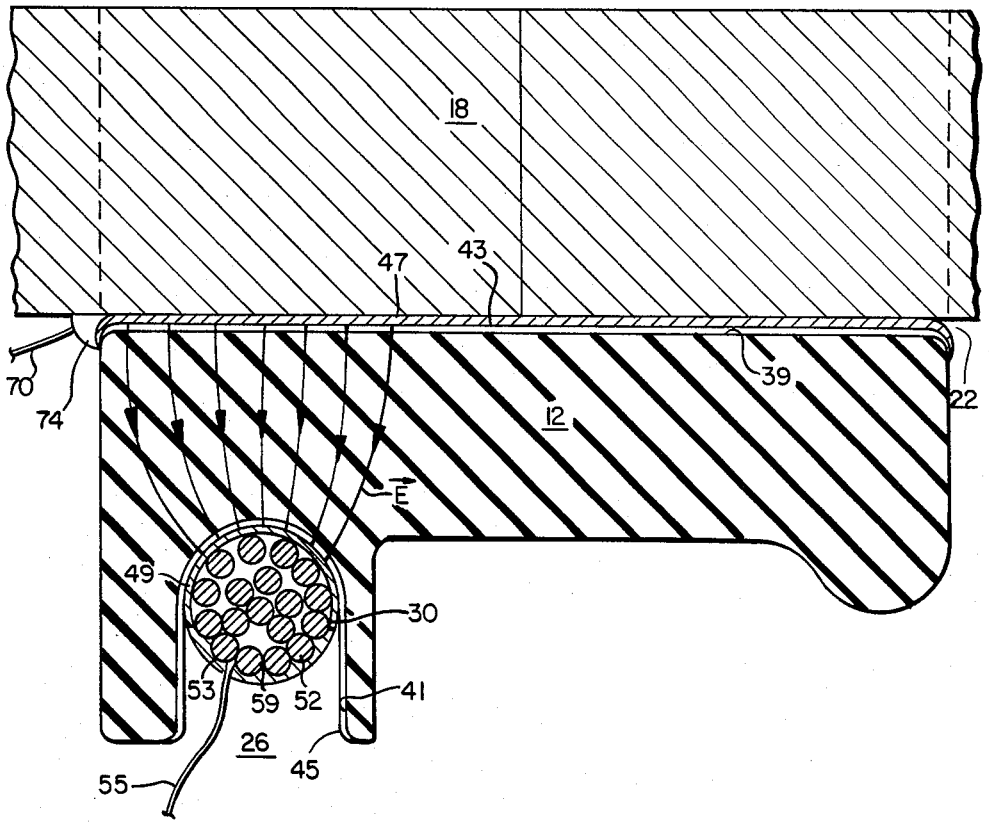
FIG. 3 is an enlarged cut-away sectional view taken along line III—III of FIG. 1.
Figure 4:
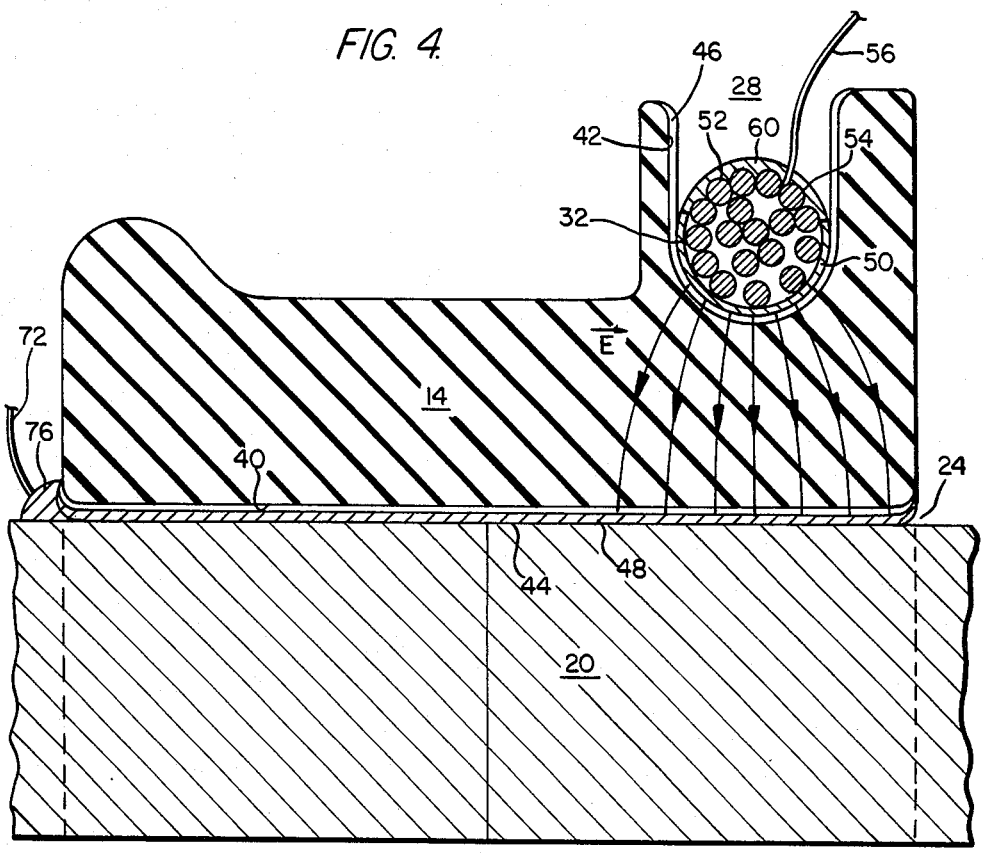
FIG. 4 is an enlarged cut-away sectional view taken along line IV—IV of FIG. 1.

FIGS. 3 and 4 respectively illustrate sections of the transformer 10 associated with primary coil 30 and secondary coil 32. The entire surfaces 39, 40 of the axial bores 22, 24 and the entire surface 41, 42 of channels 26, 28 are coated with a non-conductive compound which will adhere to the spools and provide adhesive layers 43, 44, 45, 46, respectively, capable of holding electrically conducting layers against the coated surfaces. A suitable non-conductive compound is a mixture of fifty parts by weight of an epoxy resin such as Epoxy Resin 815, a low viscosity, epichlorohydrin/bisphenol A-type epoxy resin containing a reactive diluent, fifty parts by weight of an epoxy resin reactor such as Versamid 140, a polyamide resin reactor, and approximately two hundred parts by weight of a diluent such as ethyl alcohol. Epoxy Resin 815 is commercially available from Shell Chemical Company while Versamid 140 is available from General Mills Chemicals, Inc. The diluent gives the compound a thin, water-like consistency which permits the compound to be applied to the spool's surfaces with a brush to form adhesive layers 43, 44, 45, 46 which, when dry, are approximately 0.001 to 0.002 inches thick. These layers serve as electrical insulators exhibiting very high breakdown voltages.

After the adhesive layers have dried, discrete electrostatic shields which separate spools 12, 14 from core legs 18, 20, are formed by coating the entire surfaces of the adhesive layers in the axial bores with layers 47, 48 of an electrically conducting compount. The innermost portions of a pair of electrostatic shields for encasing the primary and secondary coils are formed by applying layers 49, 50 of the same compound to the surfaces of those parts of adhesive layers 45, 46 covering the lower recesses of channels 27, 28. A suitable electrically conducting compound is a mixture of two parts by weight of a moisture-curing, polymer such as Chemglaze Z-004 (a pure polyurethane exhibiting good electrical resistance, which is commercially available from Hughson Chemical Company), three-tenths parts by weight of an electrically conductive material such as carbon black (available as XC-72R from Cabot Corporation) and approximately one part by weight of a diluent and adhesive solvent of polyurethane such as toluene, to provide a uniform dispersal of the conductive material throughout the polyurethane. The solvent gives the conducting compound a thin, water-like consistency which permits the compound to be applied with a brush to the adhesive layers. When dry, layers 47, 48, 49, 50 formed by the conducting compound are approximately 0.001 to 0.002 inches thick and exhibit an electrical conductivity significantly lower than that of copper. The adhesive nature of the conductive compound prior to drying and the bonds between the spools and the conductive layers provided by the adhesive layers are formed on and tenaciously adhere to the bores and channels of the spools without the occurrence of intervening air pockets.

After the conductive coatings have dried in the axial bores and on the lower parts of the channels of both spools, primary coil 30 and secondary coil 32 are wound in channels 26, 28 of the respective primary and secondary spools. Each coil is formed by one or more angular turns of an electrical conductor such as commercially available copper wire 52 covered with a thin coating of an insulating material. After the coils have been wound, bare, short lengths 53, 54 at ends of copper wire leads 55, 56 are laid among the outer turns of the primary and secondary windings and the remainders of the leads are extended away from the coils and beyond the channels.

After the coils have been wound, the electrostatic shields around the primary and secondary coils are completed by applying another coating of the electrically conducting compound to form layers 59, 60 approximately 0.001 to 0.002 inches thick to completely encase the primary and secondary coils and the bare ends of leads 53, 54. The coatings may be applied with a brush to take advantage of capillary action and thereby draw the coating between the turns of the coils, thus avoiding formation of air pockets between the conductive layers and the outer turns of the coils. Once applied, the electrically conducting layers 49, 50 59, 60 completely encase the primary and secondary coils.

After the electrically conductive layers have dried, the segments of the core 16 are assembled to hold primary and secondary spools 12, 14 in the head-to-toe arrangement shown in FIGS. 1 and 2. A lead 61 attached to a terminal 62, such as a lug, is electrically connected to the transformer core via a fastener 64 such as a screw, which passes through the core to join the segments together. Bare ends of electrical leads 70, 72 are inserted between the core 16 and the axial bores of primary and secondary spools 12, 14, respectively. Then, drops 74, 76 of the electrically conductive compound are applied to the core to form electrical junctions between electrical leads 70, 72, core 16, and the conductive coatings lining the axial bores of the spools.

Figure 5:
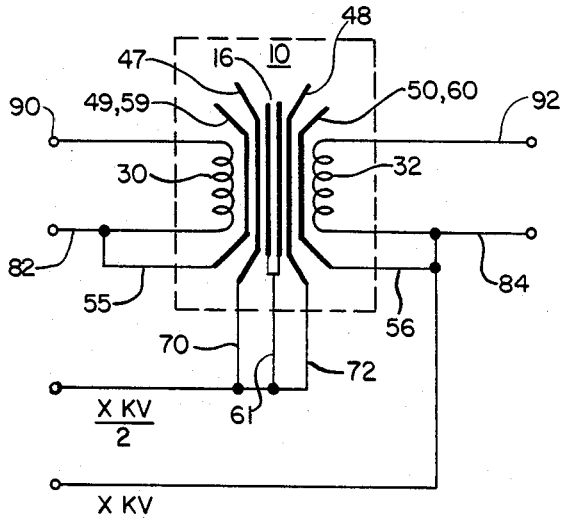
FIG. 5 is a schematic diagram of an embodiment of the invention.

As shown schematically, FIG. 5, conductive coatings 49, 50, 59, 60 encasing the primary and secondary coils 30, 32 effectively form two discrete electrostatic shields which completely encase and electrically separate the coils from the other components of the transformer. The free ends of leads 55, 56 are individually coupled to return leads 82, 84, respectively, of the corresponding primary and secondary coils 30, 32. This assures that no potential difference exists either between conductive coatings 49, 59 and return lead 82 of the primary coil or between conductive coatings 50, 60 and return lead 84 of the secondary coil, thereby avoiding the occurrence of sparking between the electrostatic shields and the coils. The lower conductivity of the conducting compound forming the electrically conducting coatings prevents the coatings from acting as short circuit turns across the corresponding coils. Leads 61, 70 and 72 are joined together to assure the absence of any potential difference (or sparking) between the electrostatic shields in the respective axial bores and the transformer core.

When placed in operation, an alternating voltage is applied across leads 82, 90 of the primary coil and by transformer action, an alternating voltage is developed across leads 84 and 92 of the secondary coil. A high amplitude, floating negative constant voltage, X, (e.g., several tens of kilovolts) may be applied to lead 84 of the secondary coil for purposes such as maintaining an electrode of an x-ray tube at that voltage. To minimize electric stress across the insulating spools, leads 61, 70 and 72 are coupled to a floating potential voltage equal in amplitude to approximately half, X/2, of the potential applied to lead 84, thereby halving the potential difference (and electric field intensity) between the electrostatic shields formed by coatings 48 and 50, 60.

The transformer disclosed may be reliably operated at high voltages without degradation due to the occurrence of electric field stresses between its coils and core. One factor which contributes to this reliability is that the effective radii of the primary and secondary coils are determined by the radii of curvature of the electrically conducting coatings 49, 50, 59, 60 (which form an intimate, electrically conductive layer completely encasing the coils) rather than by the much smaller radius of the individual terms of the coils. The proximity between the outer turns of the coils and the electrically conductive coatings and the intimate, adhesive contact between the conductive coatings and the surfaces of the circumferential channels prevents the occurrence of local concentrations in the electric fields across air pockets formed between turns of the coils and between the outer turns and the surfaces of the channels. Consequently, the presence of air pockets between the inner turns of the coils does not result in degradation of the coils because electric fields caused by the several tens of kilo-volts of constant voltage applied to return lead 84 for example, emanate from the electrostatic shield formed by conductive coatings 50, 60 around the secondary coil rather than the individual turns of secondary coil 32. Moreover, as indicated by the spacing of the lines of force, E, shown in FIGS. 3 and 4, electric fields emanating from the conductive coatings encasing the coils are widely distributed between corresponding pairs of those coatings and the conductive coatings 47, 48 lining the axial bores, thereby avoiding a dense concentration of an electric field across and subsequent degradation of, any part of the coils, spools or air gaps. In one application of an embodiment of the disclosed invention, a constant voltage of minus eighty kilovolts was applied to conductive coating 50, 60 and return lead 84 of the secondary coil while a constant voltage of minus forty kilovolts was applied to the core and conductive coatings 47, 48 in the respective axial bores of both the primary and secondary insulating spools. In that embodiment, the distance between the bottom of the circumferential channels 28, 30 and the surfaces of the axial bores 22, 24 was about two hundred mils. The potential gradient, therefore, between conductive coatings 50, 60 around the secondary winding and conductive coating 48 in the axial bore of the secondary insulating spool was approximately two hundred volts per mil. Similarly, the potential gradient between conductive coating 47 in the axial bore of the primary insulating spool and conductive coatings 49, 59 (which were coupled to the return lead of the primary winding) around the primary winding was also approximately two hundred volts per mil. A low, alternating voltage (nine to eighteen volts) was applied across the primary coil. This embodiment performed without sparking or corona, and completely isolated the constant voltage applied to the secondary coil from the primary coil.

Various modifications may be made to the embodiment disclosed without departing from the principles of this invention. The ratio between the number of turns in the primary and secondary coils may be varied, for example, to provide either a step-up or step-down of an alternating voltage applied across the primary coil. Moreover, either the primary or secondary spool may be used to support more than one winding. Also, to minimize the risk of surface arcing when the transformer is incorporated into a very high voltage network, it is desirable to encapsulate the entire high voltage network with a high dielectric potting compound. The present invention is particularly suited for such encapsulation because the presence of the electrically conducting coatings completely surrounding the coils and lining the axial bores avoids the formation of air pockets and, therefore, localized high electrical gradients either between the coils and their spools or between the surfaces of the spools within their axial bores and the transformer core.

What is claimed is:

1. An isolation transformer, comprising:

core means (16) for concentrating lines of magnetic flux in a ferromagnetic path including a pair of legs (18, 20);

a pair (12, 14) of electrically insulating means encircling different ones of said legs;

coating means (47, 48) having a first electrical conductivity adhering to said insulating means for separating said insulating means from said concentrating means;

primary (30) and secondary (32) electrical conducting means having a second and greater electrical conductivity wound around different ones of said insulating means for generating a magnetic flux in said legs; and other coating means (49,59,50,60) having said first electrical conductivity for encasing respective ones of said primary and secondary conducting means to separate said conducting means from said insulating means.

2. The isolation transformer of claim 1, wherein a first one of said encasing means (49,59) is electrically coupled to one terminal (82) of said primary conducting means and a second one of said encasing means (50,60) is electrically coupled to one terminal (84) of said secondary conducting means.

3. The isolation transformer of claim 2 wherein said separating means (47, 48) is electrically coupled to said concentrating means (16).

4. The isolation transformer of claim 1 wherein said encasing means (49,59,50,60) adhere to respective ones of said primary and secondary conducting means and adhere to the surfaces of said insulating means adjacent to respective ones of said primary and secondary conducting means.

5. The isolation transformer of claim 1 wherein encasing means (49,59,50,60) completely encase respective ones of said primary and secondary conducting means and adhere to the surfaces of said insulating means adjacent to respective ones of said primary and secondary conducting means.

6. The isolation transformer of claim 5 wherein said separating means (47, 48) comprise discrete layers of said electrically conducting coating adhering to the surfaces of said electrical insulating means adjacent to said legs.

7. The isolation transformer of claim 6 wherein said electrically conducting coating comprises a compound of a polymer, a solvent of said polymer, and an electrically conducting material dispersed throughout said polymer.

8. The isolation transformer of claim 7 wherein said electrically conducting material exhibits a lower conductivity than said electrical conducting means.

9. The isolation transformer of claim 8 wherein said electrically conducting material comprises carbon black.

10. An isolation transformer, comprising:

a closed ferromagnetic core (16) having a pair of parallel legs (18,20);

a pair of insulating spools (12,14) each having an axial bore (22,24) encircling different ones of said parallel legs;

first (47) and second (48) layers of an electrically conducting compound exhibiting a first electrical conductivity completely coating the surfaces of respective ones of said axial bores (22,24);

a primary (30) and a secondary (32) coil of materials having a second and greater electrical conductivity wound around respective ones of said primary and secondary spools and respective ones of said parallel legs; and third (49,59) and fourth (59,60) layers of said electrically conducting compound exhibiting said first electrical conductivity completely surrounding respective ones of said primary and secondary coils and coating the surfaces of said insulating spools adjacent to said coils.

11. The isolation transformer of claim 10, wherein said first and second layers of electrically conducting compound are maintained at the same potential level.

12. The isolation transformer of claim 11 wherein said first and second layers of electrically conducting compound are electrically coupled to said core.

13. The isolation transformer of claim 12, wherein said third and fourth layers (49,59,50,60) of electrical conducting compound are individually coupled to corresponding terminals (82,84) of said respective ones of said primary and secondary coils.

14. The isolation transformer of claim 13, wherein said electrically conducting compound comprises a mixture of a polymer, a solvent of said polymer, and an electrically conducting material dispersed throughout said polymer.

15. The isolation transformer of claim 13, wherein said electrically conducting compound comprises a mixture of polyurethane, a solvent of polyurethane, and carbon black dispersed throughout said polyurethane.

16. An isolation transformer, comprising:

a closed ferromagnetic core (16) having a pair of parallel legs (18, 20);

a pair of spools (12, 14) of an insulating material, each spool having an axial bore (22, 24) along its longitudinal axis and a circumferential channel (26, 28) around its outer periphery encircling said axial bore, said spools being mounted in a head-to-toe relation upon different ones of said parallel legs with the surfaces of said axial bores encircling said legs;

first (47) and second (48) layers of an electrically conducting mixture of a polymer, a solvent of said polymer, and an electrically conducting material dispersed throughout said polymer, said layers adhering to and completely coating said surfaces of respective ones of said axial bores and thereby separating said surfaces of said axial bores from said parallel legs;

means (60,70,72,74,76) for electrically connecting said first and second layers to said core;

primary (30) and a secondary (32) coils, each coil having one or more turns of electrical conductors exhibiting a greater conductivity than said mixture annularly wound around different ones of said circumferential channels to encircle respective ones of said parallel legs;

third (49,59) and fourth (50,60) layers of said mixture completely surrounding respective ones of said primary and secondary coils and penetrating between the outmost of said turns of conductors, said layers adhering to and completely coating the surfaces of said channels adjacent to said coils; and means (58, 56) for electrically coupling said third and fourth layers to terminals of respective ones of said primary and secondary coils.

* * * * *